US005432342A

United States Patent [19]

Nishimura et al.

[11] Patent Number: 5,432,342

[45] Date of Patent: Jul. 11, 1995

[54] METHOD OF AND APPARATUS FOR GENERATING LOW-ENERGY NEUTRAL PARTICLE BEAM

[75] Inventors: Tatsuya Nishimura; Hidenao Suzuki, both of Kanagawa, Japan

[73] Assignee: Ebara Corporation, Tokyo, Japan

[21] Appl. No.: 229,780

[22] Filed: Apr. 19, 1994

[30] Foreign Application Priority Data

Apr. 20, 1993 [JP] Japan ..... 5-117895

[51] Int. Cl.[6] ..... H05H 3/00

[52] U.S. Cl. ..... 250/251

[58] Field of Search ..... 250/251

[56] References Cited

U.S. PATENT DOCUMENTS

| | | | |
|---|---|---|---|
| 3,515,932 | 6/1970 | King | 313/339 |
| 4,297,615 | 10/1981 | Goebel et al. | 315/111.21 |
| 5,243,189 | 9/1993 | Nagai et al. | 250/251 |

FOREIGN PATENT DOCUMENTS

| | | |
|---|---|---|
| 0502829 | 9/1992 | European Pat. Off. . |
| 0531949 | 3/1993 | European Pat. Off. . |
| 2161293 | 7/1973 | France . |
| 61-183898 | 8/1986 | Japan . |
| 61-183899 | 8/1986 | Japan . |
| 61-183900 | 8/1986 | Japan . |
| 61-208799 | 9/1986 | Japan . |
| 63-38200 | 2/1988 | Japan . |
| 63-69127 | 3/1988 | Japan . |
| 63-143800 | 6/1988 | Japan . |
| 2-253599 | 10/1990 | Japan . |
| 3-30297 | 2/1991 | Japan . |
| 959150 | 5/1964 | United Kingdom . |

OTHER PUBLICATIONS

Shimokawa et al., "A Low-Energy Fast-Atom Source", *Nuclear Instruments & Methods in Physics Research,* vol. B33, No. 1-4, Jun. 1988, pp. 867-870.

Mase et al., "Superdense Hollow Cathode Glow Discharge and its Application to Ion Sources", *Nuclear Instruments and Methods in Physics Research,* (1989), pp. 120-123.

Johshin Uramoto, "An Accelerated Plasma Electron Beam for Vacuum Metallurgy", Mar. 20, 1977.

Joshin Uramoto, "Research of High Current and Long Life Cathode for Ion Plating", Jun. 11, 1982.

Shimokawa et al., "A Fast Atom Beam Source with a Hollow Cathode", *The Eleventh Symposium on Ion Sources and Ion-Assisted Technology,* Jun. 1-3, 1987.

*Primary Examiner*—Paul M. Dzierzynski
*Assistant Examiner*—Kiet T. Nguyen
*Attorney, Agent, or Firm*—Wenderoth, Lind & Ponack

[57] ABSTRACT

In a low-energy neutral particle beam generating apparatus having a main discharge chamber, a high-density electron beam generated in an electron beam generating unit is introduced into a main discharge chamber where it is diverged by a positive voltage applied to an anode electrode and a multipolar magnetic field formed by a permanent magnet, a main discharge gas introduced into the main discharge chamber is ionized by collision with the diverged electron beam, thereby generating a uniform plasma in the main discharge chamber, low-energy ions are drawn out from the plasma and electrically neutralized by a perforated electrode having a multiplicity of holes, thereby obtaining a low-energy neutral particle beam of large diameter without the need of using a complicated, large-sized apparatus.

15 Claims, 3 Drawing Sheets

METHOD OF AND APPARATUS FOR GENERATING LOW-ENERGY NEUTRAL PARTICLE BEAM

BACKGROUND OF THE INVENTION

1. Field of the Art

The present invention relates to a method of and apparatus for generating a low-energy neutral particle beam. More particularly, the present invention relates to a method and apparatus capable of generating a low-energy neutral particle beam which has a large diameter, low energy and a velocity higher than thermal velocity and in which neutral particles are uniform in direction.

2. Prior Art

There has heretofore been proposed a neutral particle beam generating technique wherein a saddle electric field is formed by using DC electric discharge, and a gas is ionized to produce ions by using the oscillation of electrons in the electric field, thereby generating a neutral particle beam through charge exchange and recombination with electrons. Such a neutral particle beam generating technique is, for example, shown in Japanese Patent Public Disclosure No. 183900/86. There has also been developed a neutral particle beam generating apparatus capable of raising the discharge efficiency and sustaining the electric discharge at low gas pressure by using PIG (Penning Ionization Gauge) electric discharge.

However, the above-described conventional neutral particle beam generating technique and apparatus suffer from various problems. For example, the discharge sustaining voltage is relatively high, so that the interior of a neutral particle beam source and a container may be contaminated by sputtering of an electrode constituting material. As the discharge voltage is lowered, the neutral particle beam density decreases and therefore, when it is intended to generate a neutral particle beam having a large diameter, the electric discharge becomes unstable.

There is also a method of forming a neutral particle beam by letting out heated gas molecules from a nozzle unlike the above-described neutral particle beam generating technique and apparatus. However, this method has disadvantages in that since gas molecules are heated, reaction of the furnace material with the gas molecules gives rise to a serious problem, and that it is difficult to obtain a neutral particle beam having a large diameter.

Further, a neutral particle beam generating apparatus using ECR (electron cyclotron resonance) electric discharge that utilizes resonance of a microwave and a magnetic field has recently been proposed. This apparatus suffers, however, from some problems. Namely since ECR electric discharge requires a high magnetic field intensity, the apparatus becomes large in size. Further, it is necessary in order to produce a uniform plasma to dispose a plurality of magnetic fields. As a result, the apparatus becomes complicated.

SUMMARY OF THE INVENTION

In view of the above-described circumstances, it is an object of the present invention to provide a low-energy neutral particle beam generating method and apparatus whereby it is possible to form a uniform plasma of large diameter and obtain a low-energy neutral particle beam of large diameter without the need of using a complicated, large-sized apparatus, and without causing problems involved in the prior arts stated above.

To solve the above-described problems, the present invention provides a method for generating a low-energy neutral particle beam comprising the steps of: generating a high-density electron beam; introducing a discharge gas and the high-density electron beam into an electric discharge space; diverging the electron beam in the discharge space to ionize the discharge gas by collision between the discharge gas and the diverged electron beam, thereby forming a high-density, uniform plasma in the discharge space; and drawing out low-energy ions from the plasma and electrically neutralizing the ions to thereby form a low-energy neutral particle beam.

The high-density electron beam should preferably be generated in a space separated from but communicated with the electric discharge space.

The high-density electron beam may be generated by means of a hollow cathode discharge, a hot-filament discharge, $LaB_6$ cathode discharge, a high-frequency discharge or a microwave discharge.

The diverging of the electron beam could be effected by means of an electric or magnetic or electromagnetic means.

The drawing out of the low-energy ions from the plasma may be effected by means of an electrode having a multiplicity of holes and provided on an outlet side of the discharge space and the neutralizing of the ions is effected through collision with a residual gas or recombination with low-velocity electrons near the electrode or within the holes.

During the process of drawing out low-energy ions from the plasma, ion energy may be controlled to control a velocity of the neutral particle beam.

Also, to solve the above-described problems, the present invention provides an apparatus for generating a low-energy neutral particle beam comprising; an electric discharge chamber; means for generating a high-density electron beam provided outside of the electric discharge chamber; means for introducing a discharge gas and the high-density electron beam into the electric discharge chamber; means for diverging the high density electron beam in the electric discharge chamber for forming a high-density, uniform plasma in the discharge chamber by collision between the gas and diverged electron beam; and means for drawing out low-energy ions from the plasma and for electrically neutralizing the low-energy ions.

The means for generating a high-density electron beam preferably comprises means for causing a hollow cathode discharge. The means for causing a hollow cathode discharge may comprise a casing communicated with an inlet of the electric discharge chamber; a gas inlet for introducing discharge gas into the casing; a hollow cathode disposed within the casing for causing the hollow cathode discharge between the casing and the hollow cathode; an anode electrode disposed within the casing for attracting electrons produced by the discharge toward the inlet of the electric discharge chamber; and a magnet provided around the anode electrode for converging the electrons to a high-density electron beam.

Instead, the means for generating a high-density electron beam may comprise means for causing a hot-filament discharge, $LaB_6$ cathode discharge, a high-frequency discharge or a microwave discharge.

The means for diverging the high-density electron beam may comprises an anode electrode provided around the outer periphery of the electric discharge chamber for attracting the electrons and a magnet provided around the anode electrode for reflecting the electrons.

The means for drawing out low-energy ions from the plasma and for electrically neutralizing the ion may comprises an electrode having a multiplicity of holes and provided at discharge end of the electric discharge chamber for attracting the low-energy ions thereto.

The apparatus may further comprise means for controlling ion energy in drawing out of low-energy ions from the plasma to thereby control a velocity of the neutral particle beam.

With the above-described arrangement of the present invention, since an electron beam from a high-density electron beam generating means is electrically or magnetically or electromagnetically diverged by an electron beam diverging means to thereby form a high-density, uniform plasma in the discharge chamber, it is possible to obtain a large-diameter, low-energy neutral particle beam source by an apparatus having a simple arrangement.

Also, since the electric discharge effected in the high-density electron beam generating means and that in the electric discharge chamber are independent of each other, the discharge voltage in the discharge chamber can be lowered. Thus, it becomes possible to generate a neutral particle beam of low energy. In addition, since the discharge voltage can be lowered, it is possible to suppress sputtering of the electrode and minimize contamination.

Further, since the arrangement is relatively simple, it is possible to readily comply with a demand for an increase in the diameter of the neutral particle beam by changing the size of the discharge chamber.

The above and other objects, features and advantages of the present invention will become more apparent from the following description when taken in conjunction with the accompanying drawings in which a preferred embodiment of the present invention is shown by way of illustrative examples.

Figure 1:
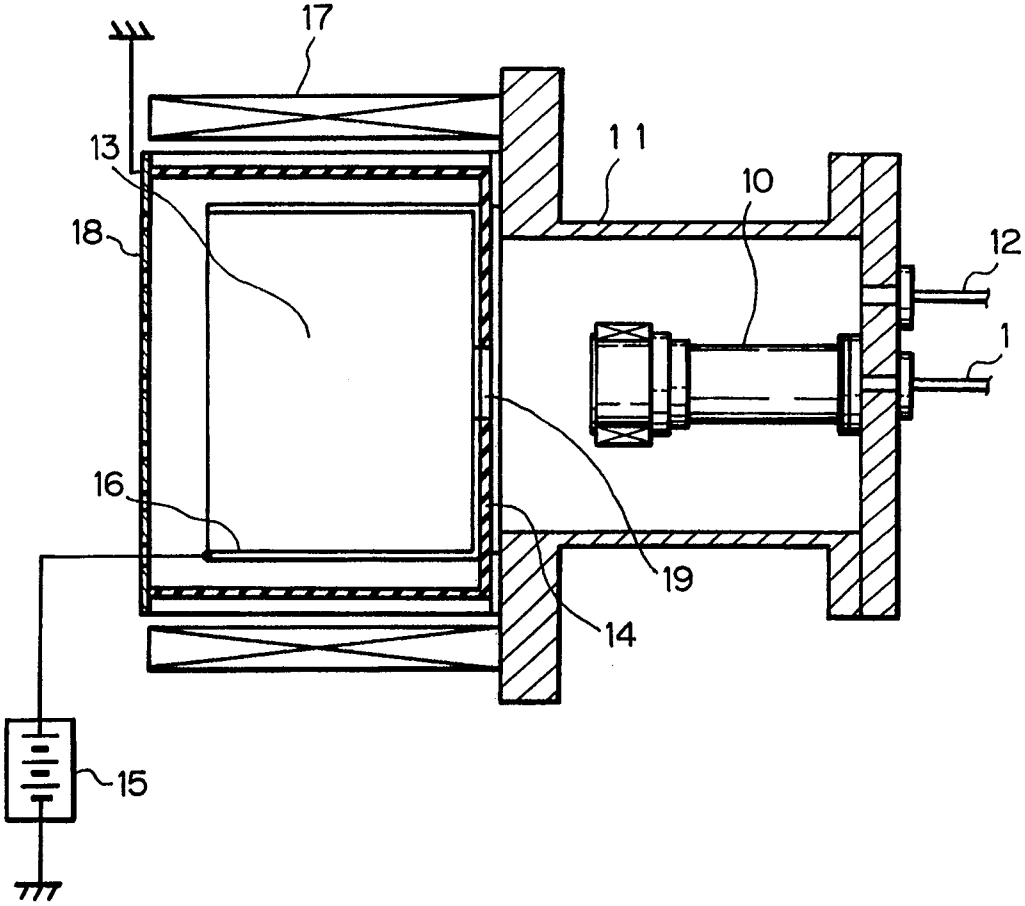
FIG. 1 shows an example of the arrangement of the low-energy neutral particle beam generating apparatus according to the present invention.
Figure 3A:
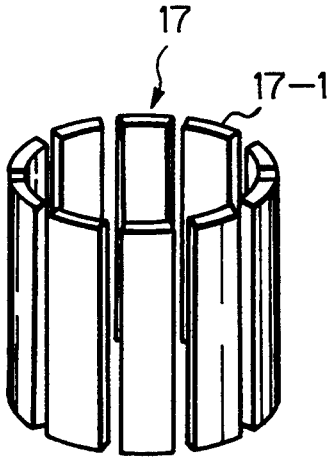
FIGS. 3(*a*) and 3(*b*) show the arrangement of a permanent magnet 17, in which FIG. 3(*a*) shows the external appearance of the permanent magnet, and FIG. 3(*b*) is a plan view thereof.
Figure 3B:
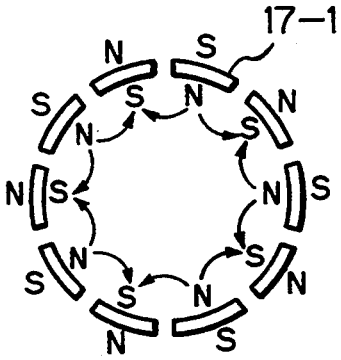

PREFERRED EMBODIMENT OF THE INVENTION:

One preferred embodiment of the present invention will be described below with reference to the accompanying drawings. FIG. 1 shows the arrangement of the low-energy neutral particle beam generating apparatus according to the present invention. Reference numeral 11 denotes a cylindrical electron beam casing. An electron beam generating unit 10 (described later in detail) is fitted in the electron beam casing 11. A cylindrical main discharge chamber 13 is provided adjacent to the electron beam casing 11 and is communicated thereto. A cup shaped anode electrode 16 is disposed around the outer periphery of the main discharge chamber 13, and a permanent magnet 17 is disposed outside the anode electrode 16 with an insulating material 14 interposed therebetween. As shown in FIGS. 3(*a*) and 3(*b*), the permanent magnet 17 is arranged in the form of a multipolar permanent magnet by disposing a multiplicity of permanent magnet pieces 17-1 in a cylindrical configuration.

Referring to FIG. 1, a main discharge gas inlet 12 is provided in the electron beam casing 11 to introduce a main discharge gas from a main discharge gas source (not shown). An anode DC power supply 15 is provided to apply a positive voltage to the anode electrode 16. A perforated electrode 18 has a multiplicity of holes for drawing out low-energy ions from a plasma formed in the main discharge chamber 13. Reference numeral 19 denotes an electron beam inlet which communicates between the main discharge chamber 13 and the electron beam casing 11.

Figure 2:
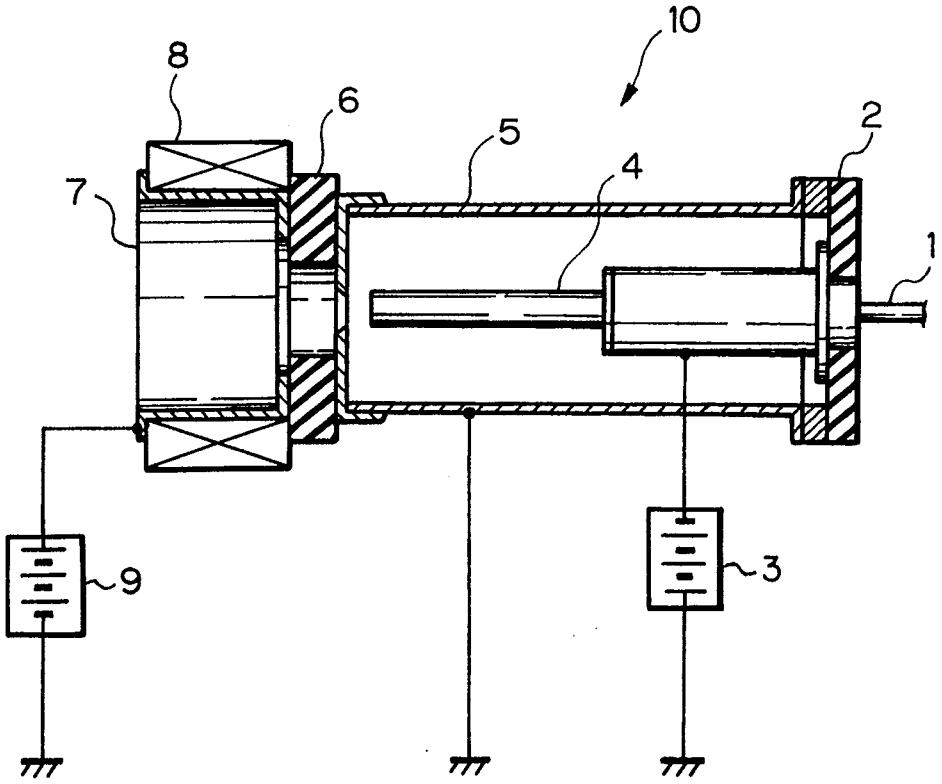
FIG. 2 shows the arrangement of an electron beam generating unit attached to the low-energy neutral particle beam generating apparatus shown in FIG. 1.
Figure 4:
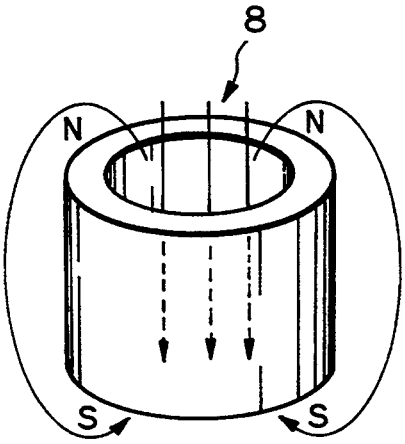
FIG. 4 shows the external appearance of a permanent magnet 8.

FIG. 2 shows the arrangement of the electron beam generating unit 10. A cylindrical casing 5 has a hollow cathode 4 disposed therein. A cup shaped anode electrode 7 is disposed at the forward end of the casing 5 with an insulating material 6 interposed therebetween. A cylindrical permanent magnet 8, which is arranged as shown in FIG. 4, is disposed outside the anode electrode 7. It should be noted that in FIG. 2 reference numeral 1 denotes an Ar gas inlet for introducing Ar gas into the casing 5, and 2 an insulating material provided on the rear end portion of the casing 5. A hollow cathode DC power supply 3 is provided to apply a negative voltage to the hollow cathode 4. An anode DC power supply 9 is provided to apply a positive voltage to the anode electrode 7.

The following is a description of the operation of the electron beam generating unit 10, arranged as described above, and the operation of the low-energy neutral particle beam generating apparatus, which is equipped with the electron beam generating unit 10. First, in the electron beam generating unit 10 shown in FIG. 2, Ar gas is introduced into the casing 5 from the Ar gas inlet 1, and a negative voltage is applied to the hollow cathode 4 from the hollow cathode DC power supply 3, thereby inducing a hollow cathode discharge between the hollow cathode 4 and the casing 5. Electrons produced by the hollow cathode discharge are accelerated toward the anode electrode 7 having a positive voltage being applied thereto from the anode DC power supply 9, and while being accelerated in this way, the electrons are converged to the central portion of the anode electrode 7 by the action of an axial magnetic field produced by the permanent magnet 8, thereby forming a high-density electron beam.

The high-density electron beam from the electron beam generating unit 10 is introduced into the main discharge chamber 13 through the electron beam inlet 19, together with the main discharge gas, which is introduced from the main discharge gas inlet 12. In the main discharge chamber 13, the orbit of the electron beam is bent by the potential of the positive voltage applied to the anode electrode 16 from the anode DC power supply 15, so that the electrons spread over the whole main discharge chamber 13. The electrons spread over the whole main discharge chamber 13 are urged to flow into the anode electrode 16. However, the electrons are reflected by a multipolar magnetic field formed by the permanent magnet 17 around the outer periphery of the anode electrode 16. Thus, the electrons cannot immediately reach the anode electrode 16 but repeat reciprocating motion in the main discharge chamber 13.

The reciprocating motion (diverging motion) of the electrons in the main discharge chamber 13 causes the electrons to repeat collision with the main discharge gas in the main discharge chamber 13, thus ionizing the main discharge gas and producing electrons. Such ionization chain-reactingly occurs in the whole of the main discharge chamber 13. As a result, a high-density, uniform plasma is formed in the main discharge chamber 13. Since the perforated electrode 18 is grounded, the ions in the plasma formed in the main discharge chamber 13 are accelerated by the action of an electric field (sheath electric field) produced by the potential difference between the plasma and the perforated electrode 18, and attracted to the perforated electrode 18. When passing through the holes in the perforated electrode 18, the ions collide with the residual neutral gas or recombine with low-velocity electrons near electrode 18 or within the holes, thereby losing their electric charge, and thus becoming neutral particles.

The neutral particles having lost their electric charge are released from the holes in the perforated electrode 18 in the form of a neutral particle beam with the kinetic energy in the ionic state conserved. The kinetic energy of the released neutral particle beam is approximately equal to the potential applied To the anode electrode 16 and, therefore, can be controlled by varying the voltage applied to the anode electrode 16.

With the above-described arrangement of the lowenergy neutral particle beam generating apparatus, the high-density electron beam from the electron beam generating unit 10 can be electromagnetically diverged in the main discharge chamber 13. Thus, a plasma of large diameter and high density can be formed in the main discharge chamber 13. Accordingly, a large-diameter, high-density plasma can be readily obtained without the need of using a complicated magnetic field arrangement. Thus, the whole apparatus can be simplified.

In addition, since the electron beam generating unit 10 is independent of the low-energy neutral particle beam generating apparatus, it is possible to lower the discharge voltage in the main discharge chamber 13 (i.e., the voltage applied to the anode electrode 16) and hence possible to generate neutral particles of low energy. Further, owing to the low-voltage electric discharge, sputtering of the anode electrode 16 is suppressed, and contamination is also minimized. It is also possible to readily comply with a demand for an increase in the diameter of the neutral particle beam by changing the size of the main discharge chamber 13.

Although in the foregoing embodiment hollow cathode discharge is used to generate an electron beam in the electron beam generating unit 10, it should be noted that the present invention is not necessarily limited to the hollow cathode discharge, and that generation of an electron beam may also be effected by hot-filament discharge, $LaB_6$ cathode discharge, high-frequency discharge, microwave discharge, etc.

Although in the foregoing embodiment the permanent magnets 17 and 8 are used as means for forming magnetic fields in the low-energy neutral particle beam generating apparatus shown in FIG. 1 and in the electron beam generating unit 10 shown in FIG. 2, respectively, it should be noted that these magnetic field forming means are not necessarily limited to permanent magnets but may be electromagnets. As the main discharge gas used in the low-energy neutral particle beam generating apparatus, various kinds of gas may be used according to the use application of the neutral particle beam generated.

As has been described above, the low-energy neutral particle beam generating method and apparatus of the present invention provides the following advantageous effects:

Since an electron beam is diverged in the discharge space to form a high-density, uniform plasma in the discharge space, a low-energy neutral particle beam with a large diameter can be readily obtained.

Since an electron beam from a high-density electron beam generating means provided independently of the discharge chamber is electrically or magnetically or electromagnetically diverged by an electron beam diverging means to thereby form a high-density, uniform plasma in the discharge chamber, it is possible to obtain a large-diameter, low-energy neutral particle beam source by an apparatus having a simple arrangement.

Since the electric discharge induced In the high-density electron beam generating means and that in the discharge chamber are independent of each other, the discharge voltage in the discharge chamber can be lowered. Thus, it becomes possible to generate a neutral particle beam of low energy. In addition, since the discharge voltage can be lowered, it is possible to suppress sputtering of the electrode and minimize contamination.

Further, since the arrangement can be made relatively simple, it is possible to readily comply with a demand for an increase in the diameter of the neutral particle beam by changing the size of the discharge chamber.

What is claimed is:

1. A method for generating a low-energy neutral particle beam comprising the steps of:

generating a high-density electron beam;

introducing a discharge gas and said high-density electron beam into an electric discharge chamber.

diverging said electron beam in said discharge space to ionize said discharge gas by collision between said discharge gas and said diverged electron beam, thereby forming a high-density, uniform plasma in said discharge chamber; and drawing out low-energy ions from said plasma and electrically neutralizing said ions to thereby form a low-energy neutral particle beam.

2. A method for generating a low-energy neutral particle beam according to claim 1, wherein said high-density electron beam is generated in a space separated from and communicated with said electric discharge chamber.

3. A method for generating a low-energy neutral particle beam according to claim 2, wherein said high-density electron beam is generated by means of a hollow cathode discharge, a hot-filament discharge, $LaB_6$ cathode discharge, a high-frequency discharge or a microwave discharge.

4. A method for generating a low-energy neutral particle beam according to claim 1, wherein said diverging of said electron beam is effected by means of an electric, magnetic, or electromagnetic means.

5. A method for generating a low-energy neutral particle beam according to claim 1, wherein said drawing out of said low-energy ions from said plasma is effected by means of an electrode having a multiplicity of holes and provided on an outlet side of said discharge chamber for attracting said ions thereto and said neutralizing of said ions is effected through collision with a residual gas or recombination with low-velocity electrons near said electrode or within said holes to thereby lose their electric charge.

6. A method for generating a low-energy neutral particle beam according to claim 1, wherein during the process of drawing out low-energy ions from said plasma, ion energy is controlled to control a velocity of said neutral particle beam.

7. An apparatus for generating a low-energy neutral particle beam comprising:

an electric discharge chamber;

means for generating a high-density electron beam provided outside of said electric discharge chamber;

means for introducing a discharge gas and said high-density electron beam into said electric discharge chamber;

means for diverging said high density electron beam in said electric discharge chamber for forming a high-density, uniform plasma in said discharge chamber by collision between said discharge gas and said diverged electron beam; and means for drawing out low-energy ions from said plasma and for electrically neutralizing said low-energy ions.

8. An apparatus for generating a low-energy neutral particle beam according to claim 7, wherein said means for generating a high-density electron beam comprises means for causing a hollow cathode discharge.

9. An apparatus for generating a low-energy neutral particle beam according to claim 8, wherein said means for causing a hollow cathode discharge, further comprises a casing communicated with an inlet of said electric discharge chamber;

a gas inlet for introducing said discharge gas into said casing;

said a hollow cathode disposed within said casing for causing said hollow cathode discharge between said casing and said hollow cathode;

an anode electrode disposed within said casing for attracting electrons produced by said discharge toward said inlet of said electric discharge chamber; and a magnet provided around said anode electrode for converging said electrons to a high-density electron beam.

10. An apparatus for generating a low-energy neutral particle beam according to claim 7, wherein said means for generating a high-density electron beam comprises means for causing a hot-filament discharge, $LaB_6$ cathode discharge, a high-frequency discharge, or a microwave discharge.

11. An apparatus for generating a low-energy neutral particle beam according to claim 7, wherein said means for diverging said high-density electron beam comprises an anode electrode provided around outer periphery of said electric discharge chamber for attracting said electrons and a magnet provided around said anode electrode for reflecting said electrons.

12. An apparatus for generating a low-energy neutral particle beam according to claim 11, wherein said magnet is a multipolar permanent magnet.

13. An apparatus for generating a low-energy neutral particle beam according to claim 7, wherein said means for drawing out low-energy ions from said plasma and for electrically neutralizing said ions comprises an electrode having a multiplicity of holes and provided at the discharge end of said electric discharge chamber for attracting said low-energy ions thereto.

14. An apparatus for generating a low-energy neutral particle beam according to claim 7, further comprising means for controlling ion energy in drawing out of low-energy ions from said plasma to control a velocity of said neutral particle beam.

15. An apparatus for generating a low-energy neutral particle beam according to claim 14, wherein said control means comprises means for varying the voltage applied to said anode electrode.

* * * * *